United States Patent [19]

Newman

[11] Patent Number: 4,691,455

[45] Date of Patent: Sep. 8, 1987

[54] TRENCHING EQUIPMENT WITH HINGED SIDE PLATES

[76] Inventor: Russell L. Newman, 4591 Cathy Ave., Cypress, Calif. 90630

[21] Appl. No.: 778,030

[22] Filed: Sep. 20, 1985

[51] Int. Cl.[4] ..... E02F 5/02

[52] U.S. Cl. ..... 37/103; 37/DIG. 16

[58] Field of Search ..... 37/103, 117.5, DIG. 16, 37/71, 80 A; 405/180-182

[56] References Cited

U.S. PATENT DOCUMENTS

| | | | |
|---|---|---|---|
| 2,602,410 | 7/1952 | Vaughn | 37/80 A |
| 3,000,120 | 9/1961 | Larue et al. | 37/103 |
| 3,681,863 | 8/1972 | Sointsev et al. | 37/DIG. 16 |
| 3,792,539 | 2/1974 | Clark | 37/103 |
| 3,986,280 | 9/1976 | Johnson | 37/80 A |
| 4,432,672 | 2/1984 | Bruderle et al. | 37/DIG. 16 |

FOREIGN PATENT DOCUMENTS

| | | | |
|---|---|---|---|
| 588675 | 2/1959 | Italy | 37/103 |
| 534552 | 2/1977 | U.S.S.R. | 37/103 |
| 620542 | 8/1978 | U.S.S.R. | 37/103 |
| 979583 | 12/1982 | U.S.S.R. | 37/71 |
| 1073390 | 2/1984 | U.S.S.R. | 37/103 |

*Primary Examiner*—E. H. Eickholt

*Attorney, Agent, or Firm*—Fulwider, Patton, Rieber, Lee & Utecht

[57] ABSTRACT

This invention relates to an improved trenching bucket for use with trenching equipment such as backhoes, wherein the side plates of the bucket are adjustable so that trenches can be formed with walls at various slopes.

9 Claims, 12 Drawing Figures

FIG. 6
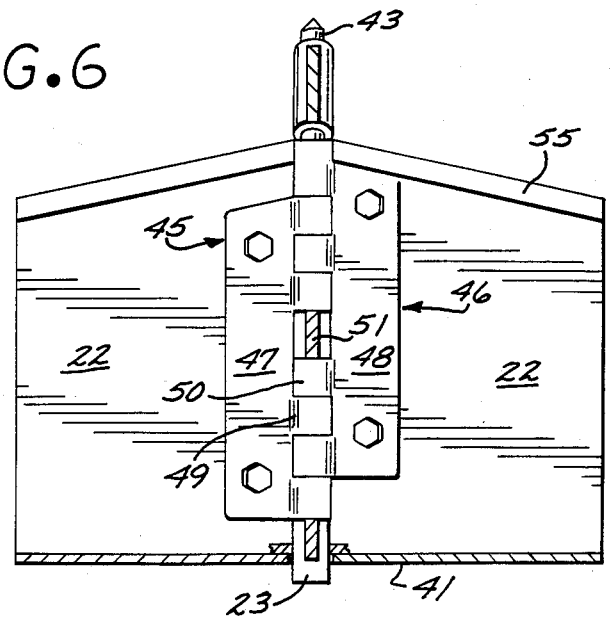
FIG. 7
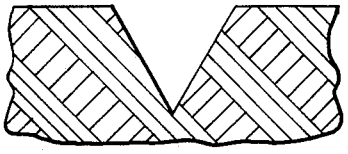
FIG. 8
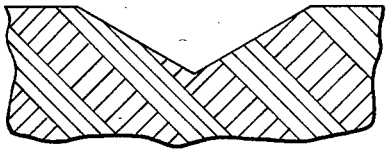
FIG. 11
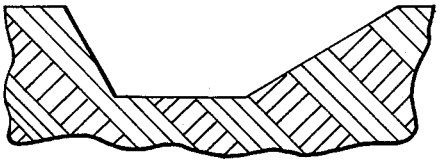
FIG. 12
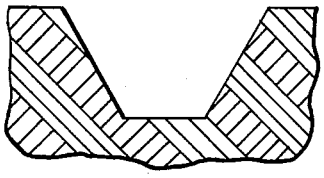
FIG. 9
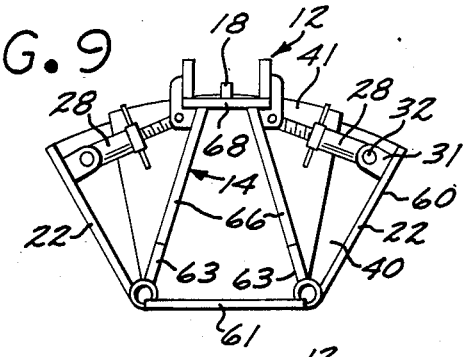
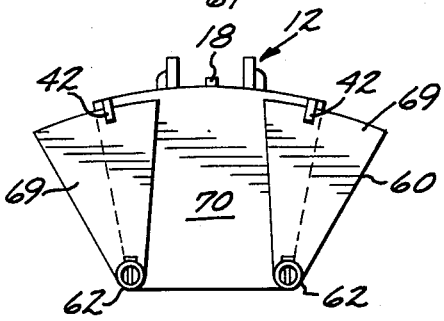
FIG. 10

TRENCHING EQUIPMENT WITH HINGED SIDE PLATES

BACKGROUND OF THE INVENTION

This invention generally relates to the field of mobile equipment for digging trenches.

In construction and landscaping work it is frequently necessary to dig trenches with walls at angles which vary from the vertical, and many times it is desirable to form a trench wherein each of the side walls thereof are at different angles from the vertical. While there are many prior art devices form trenches with angled side walls, many are inconvenient to use and, none provide any capability of varying the angle to suit the particular needs of a situation. Typical prior art devices for forming trenches with inclined side walls are shown in the following references:

U.S. Pat. No. 2,480,656 (Jenne),
U.S. Pat. No. 2,972,425 (Anderson, et al.),
U.S. Pat. No. 3,003,264 (Shore),
U.S. Pat. No. 3,792,539 (Clark).

In the Jenne, Shore and Clark references the side walls of the trench are formed by a blade or wing which are attached to the front or leading edge of a backhoe or drag line bucket. In the Anderson, et al. reference the bucket is provided with fixed, angled sides which form the sloping walls of a trench. None of the described devices are provided with means to adjust the angle of the side plate of the bucket.

Other references relating to backhoes or drag line buckets for forming trenches which may be of interest are U.S. Pat. No. 3,089,261 (Flath) and U.S. Pat. No. 3,286,377 (Long) which describe wing-like devices attached to the vertical side walls of the bucket to change the cross-sectional shape of the trench. However, no attempt is made to change the angle of the side wall.

For other prior art devices showing a scraping type action for the removal of dirt and the like, reference is made to the following references:

U.S. Pat. No. 2,261,874 (Cundiff),
U.S. Pat. No. 2,556,592 (Markkula),
U.S. Pat. No. 2,662,311 (Chattin),
U.S. Pat. No. 2,673,409 (Briscoe),
U.S. Pat. No. 2,856,709 (Brockly).
U.S. Pat. No. 3,526,047 (Roessler, et al.)

These references primarily are directed to devices having blades which scrape or plow the ground. They do not involve a trench forming type of bucket.

From the above, it is clear that the need remains for a bucket for a trenching device which can form trenches with walls of varying slope and, particularly, a device which can readily vary the slope to meet the particular job requirements without significant modifications to the bucket or the need to replace buckets for particular angled walls. The present invention satisfies this need.

SUMMARY OF THE INVENTION

This invention relates to an improvement in trench-forming equipment such as backhoe tractors, drag lines and the like and, particularly, to buckets for such trenching equipment in which the side plates can be adjusted to form trenches with walls having varying slopes.

In accordance with the present invention an open top bucket is provided with adjustable side plates which are hinged so that the angle of the side plates with respect to the vertical can be readily changed by pivoting the side plates about the axis of the hinged connection. Where the trench is to have a V-shaped cross-section the side plates are hingedly connected together along their lower edge. In those situations where the cross-sectional shape of the trench is to be trapezoidal, the bucket is provided with a floor plate and the side plates of the bucket are hingedly connected along the edges of the floor plate. The bucket is provided with a back wall which is preferably sectioned with the outer sections fixed to the trailing edge of the side plates and fan-shaped in order to form a continuous back wall notwithstanding the inclination of the side plates.

The bucket is provided with means to adjust the inclination of the side plates thereof and, preferably, individual jacks are provided for each side plate so that the angle of each can be separately adjusted as desired.

The backhoe or drag line having a bucket in accordance with the invention is operated in a conventional manner. The only difference is varying the angle of the side plates to form a trench having the desired shape. If desired, hydraulic control means can be provided to adjust the angle of the side plates and the hand controls for such control means may be conveniently provided along with the other operational controls in the operator's console for the backhoe or drag line so that the angle of the side wall can be adjusted as necessary by the operator during the formation of the trench without dismounting from the vehicle.

These and other advantages of the invention will become apparent from the following detailed description when taken in conjunction with the accompanying exemplary drawings.

BRIEF DESCRIPTION OF THE DRAWINGS

FIG. 6 is a plan view, partially in section, of the bucket taken along the lines of 6—6 shown in FIG. 2.

FIGS. 7 and 8 illustrate the cross-sectional shape of trenches formed with the bucket shown in FIGS. 1–6.

FIGS. 9 and 10 are respectively front and rear views of a modified bucket provided with a floor plate.

FIGS. 11 and 12 illustrate the cross-sectional shape of trenches formed with the bucket shown in FIGS. 9 and 10.

DETAILED DESCRIPTION OF THE INVENTION

Figure 1:
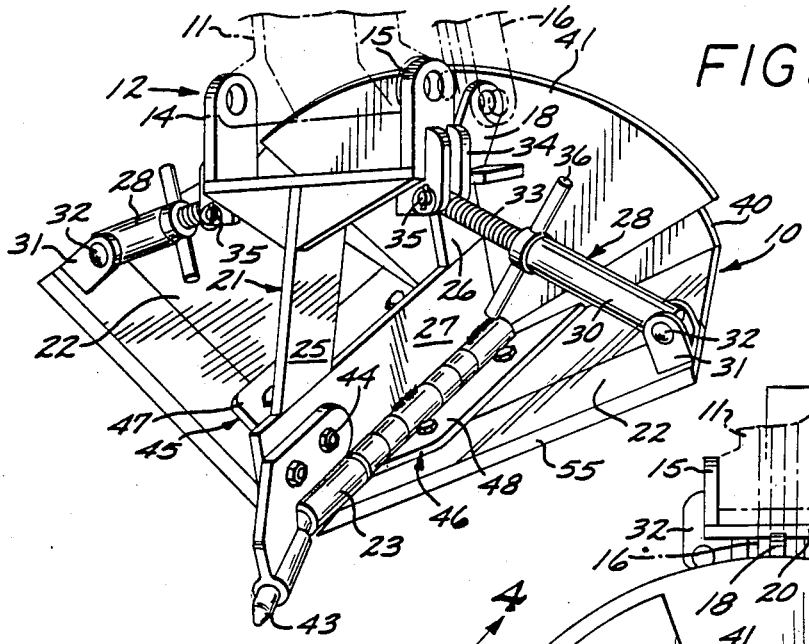
FIG. 1 is a perspective view of an embodiment of the invention which is designed for forming V-shaped trenches.

Reference is made to FIGS. 1–6 which illustrate a bucket 10 embodying features of the invention. As is shown in these drawings, the bucket 10 is pivotally connected to the end of a boom or, more specifically, the dipper stick 11 (shown in phantom in FIG. 1) of a tractor-mounted backhoe (not shown) or other similar trenching equipment. The pivotal connection with bucket 10 is made by means of a yoke 12 and a pin 13 which passes between the upstanding ears 14 and 15 of the yoke 12 and the end of the dipper stick 11. The bucket 10 is rotated about the axis of the pin 13 by means of an operating rod 16 which is pivotally connected by pin 17 to the upstanding ear 18 mounted on the upper member or hanger base plate 20 of the support frame 21. The rod 17 is the operative element of a fluid actuated cylinder (not shown) which forms part of the operative mechanism of the backhoe.

The bucket 10 generally comprises a pair of matching side plates 22, which are pivotally connected along the mating edges thereof by means of a hinge 23, a sectioned back wall 24 and a support frame 21 which includes the hanger base plate 20, struts 25 and 26, a hinge bar 27, and a pair of jack elements 28 which are utilized to adjust the orientation of the side plates 22 about the axis of the hinge 33. The jack elements 28 generally comprise a female member 30 which is pivotally connected by means of bracket 31 and pin 32 to the inside surface of the side plate 22, and a male member 33, internally mounted to female member and threaded on the exterior thereof, which is pivotally connected to the end of the yoke 12 by means of a bracket 34 and a pin 35. A threaded collar 36 with a handle is provided for adjusting the movement of the male member 33 with respect to the female member 30 to thereby adjust the orientation of the side plate 22 about the axis of the hinge 23.

Figure 2:
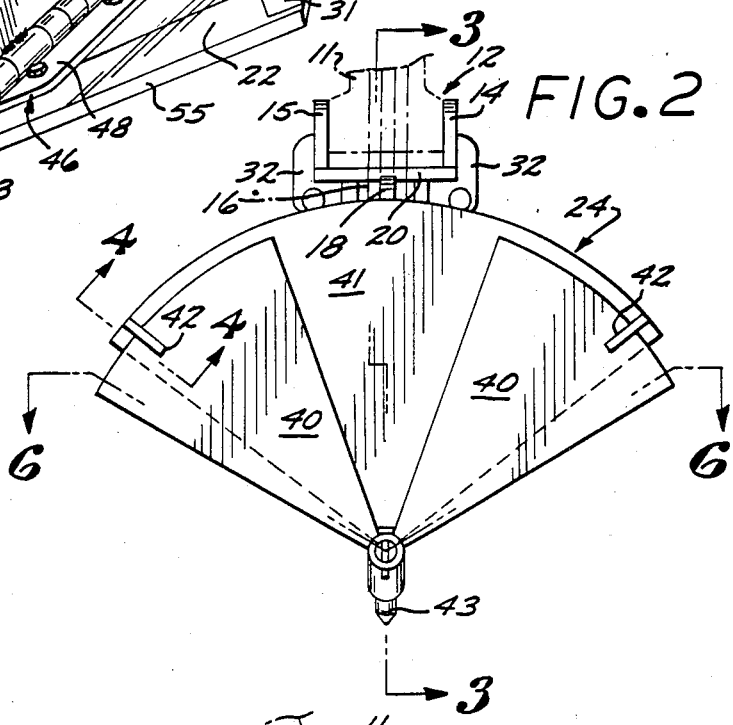
FIG. 2 is a rear view of the bucket shown in FIG. 1.
Figure 4:
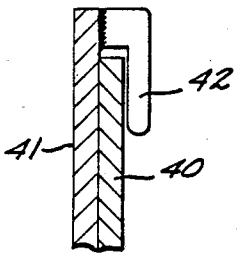
FIG. 4 is a sectional view of the back wall of the bucket taken along the lines 4—4 shown in FIG. 2.
Figure 3:
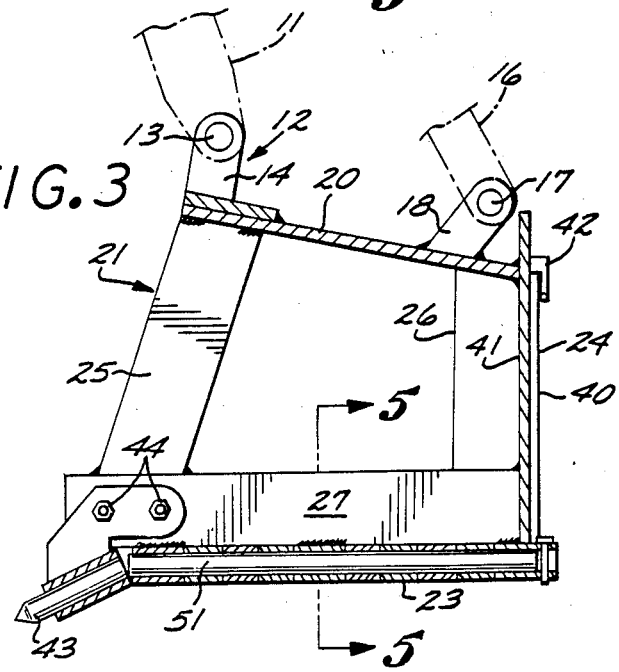
FIG. 3 is a side view in section taken along the lines of 3—3 shown in FIG. 2.

The back wall 24 of the bucket 10 is sectioned and, preferably each of the sections overlap and are fan-shaped so that the wall remains continuous, notwithstanding the occluded angle between the side plates 22. As shown in FIG. 2, each of the outside sections 40 are fixed to or are integrally formed with the adjacent side plates 32 and are adapted to move therewith. A center fan-shaped section 41 is stationary and fixed to the rear strut 26 of support frame 21 by suitable means, such as by welding. As shown in FIGS. 2, 3 and 4, finger guide elements 42 are provided on the back surface of stationary section 41 to support and guide the movable back wall sections 40 in the various positions thereof occasioned by the orientations of the side plates 22 which are caused by adjustments of the jack elements 28.

A plow or nose element 43, which is centrally positioned at the front or leading edge of the bucket 10, is mounted by bolts 44 to the hinge bar 27 to aid in keeping the bucket 10 on track during use.

Figure 5:
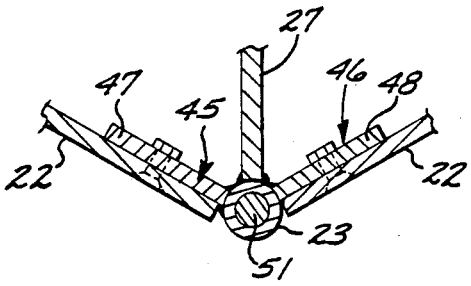
FIG. 5 is a sectional view of the center portion of the bucket taken along the lines of 5—5 shown in FIG. 3.

FIGS. 3, 5 and 6 illustrate in detail the structure of the hinge 23 which generally comprises two interfitting leaf sections 45 and 46 having mounting flanges 47 and 48, respectively. The side plates may be affixed to the flanges 47 and 48 in any desired fashion, such as by welding or bolting as shown in FIG. 6. The leaf sections 45 and 46 are formed with interfitting barrel segments 49 and 50, respectively, which facilitate the insertion of the hinge pin 51 which holds the leaf sections together and allows the rotation of the leaf sections about the hinge axis. One or more of barrel segments 49 and 50 may be welded to the hinge bar 27 as shown in FIGS. 3 and 5.

The leading edge 55 of the bucket, as viewed in top plan view in FIGS. 1 and 6, is generally tapered outwardly and rearwardly into a spade-like configuration to facilitate digging into the ground during the use of the bucket. If desired, separate cutting blades with teeth may be fixed to this leading edge to protect the edge 55 from wear and to facilitate digging into the ground.

FIGS. 9 and 10 illustrate the front and rear views, respectively, of a modified bucket 60 which has a floor plate 61. The side plates 22 are hingedly connected along the outer edges of floor plate 61 by means of hinges 62 which are mounted to hinge bars 63. The support frame 64 of this particular embodiment has two depending components 65 which are similar to the single support frame 21 of the first described embodiment. Each of the depending components 65 is provided with a forward strut 66, a rear strut 67 and a hinge bar 63 to which the hinges 62 are connected. However, only one hanger base plate 68 is utilized and both forward struts 66 and rear struts 67 are welded or otherwise connected thereto. The yoke 12 and the upstanding ear 18 are fixed to the upper surface of the hanger base plate 68. The modified bucket 68 is pivotally connected to the rear of a dipper stick 11 and the operating rod 16 by means of the yoke 12 and ear 16 as described for the first embodiment. The back wall is sectioned, as shown, with the two fan-shaped outer sections 69 fixed to or formed integral with the ends of the adjacent side plates 22 and overlap the stationary, fan-shaped section 20 secured to the support frame 64. The outside sections 69 move with the side plates 22 when the orientation thereof is adjusted by jacks 28.

The bucket in accordance with the invention can be easily adjusted to form a trench having a wide variety of angled sides as shown in FIGS. 7 and 8 and 11 and 12. As indicated in FIG. 11, the trenches formed by the bucket of the invention need not be symmetrical around a vertical center line. The side plates 22 may be individually adjusted to provide the desired orientation for each wall of the trench formed. Other modifications to the invention can be made without departing from the scope thereof.

What is claimed is:

1. An open top excavation bucket for forming trenches, comprising:

a. a support frame;

b. a pair of side plates hingedly connected along the lower edges thereof and supported from the support frame so that each of the side plates may be rotated about the axis of its hinge connection;

c. a back wall;

d. means connected to the side plates to adjust the orientation thereof about the axis of the hinge connection.

2. The excavation bucket of claim 1, wherein the back wall is provided with overlapping sections.

3. The excavation bucket of claim 2, wherein overlapping sections of the back wall are fan-shaped.

4. The excavation bucket of claim 1, wherein the support frame comprises a hanger base plate, one or more struts depending from the hanger base plate and a hinge bar fixed to the lower portion of the one or more struts.

5. The excavation bucket of claim 4, wherein the support frame is provided with a yoke fixed to the hanger base plate to facilitate the pivotal mounting of the excavation bucket to the end of a dipper stick.

6. The excavation bucket of claim 5, wherein at least one upstanding ear is fixed to the hanger base plate to facilitate the connection thereto of an operating rod of a fluid actuated cylinder to pivot the bucket about the axis of the pivotal mounting of the yoke to the end of the dipper stick.

7. The excavation bucket of claim 1, wherein jacking means are provided connecting each of the side plates to the support frame to facilitate adjustment of the orientation of the side plates about the axis of the hinge connection by adjusting the length of the jacking means.

8. The excavation bucket of claim 7, wherein the jacking means comprises a female member and an externally threaded male member connected within the female member, said jacking means being pivotally connected at one end thereof to the support frame and the other end thereof to a side plate, and provided with rotational means on the male member to adjust the length of the jacking means and to thereby vary the orientation of the side plate connected thereto about the hinge connection.

9. An open top excavation bucket for forming trenches, comprising:

a. support frame;

b. a floor plate affixed to said support frame;

c. a pair of side plates hingedly connected along their lower edges to the outer edges of said floor plates by means of hinges affixed to such support frame or said floor plate;

d. a back wall; and e. means connected to the side plates to adjust the orientation thereof about the axis of the hinge connection.

* * * * *